United States Patent [19]

Beacham et al.

[11] Patent Number: 4,552,687

[45] Date of Patent: Nov. 12, 1985

[54] ELECTRICALLY CONDUCTIVE PLASTICS AND PRODUCTION OF SAME

[75] Inventors: Harry H. Beacham, Langhorne, Pa.; Paul R. Mucenieks, Lawrenceville, N.J.

[73] Assignee: FMC Corporation, Philadelphia, Pa.

[21] Appl. No.: 512,286

[22] Filed: Jul. 8, 1983

[51] Int. Cl.[4] ..... H01B 1/00

[52] U.S. Cl. ..... 252/500; 524/129; 524/912; 260/DIG. 16; 260/DIG. 21

[58] Field of Search ..... 252/500; 524/129, 912; 260/DIG. 21, DIG. 16, DIG. 17

[56] References Cited

U.S. PATENT DOCUMENTS

| | | | |
|---|---|---|---|
| 3,264,255 | 8/1966 | Taylor | 260/45.75 |
| 3,420,917 | 1/1969 | Wu | 260/932 |
| 3,629,365 | 12/1971 | Gardner | 260/857 PE |
| 3,657,352 | 4/1972 | Kleiner | 260/606.5 P |
| 3,681,281 | 8/1972 | Juelke et al. | 260/45.8 N |
| 3,709,852 | 1/1973 | Gordon et al. | 260/88.2 S |
| 4,005,057 | 1/1977 | Singh et al. | 524/912 |
| 4,038,258 | 7/1977 | Singh et al. | 524/192 |
| 4,061,615 | 12/1977 | Couchoud | 524/192 |
| 4,377,653 | 3/1983 | Fietz | 524/129 |

*Primary Examiner*—Josephine L. Barr

*Attorney, Agent, or Firm*—Robert D. Jackson; Eugene G. Horsky

[57] ABSTRACT

Thermoplastic polymers, having antistatic properties, are obtained by incorporating in the polymers a liquid mixture of trialkylphosphine oxides.

9 Claims, No Drawings

ELECTRICALLY CONDUCTIVE PLASTICS AND PRODUCTION OF SAME

This invention relates to electrically conductive polymeric compositions. More particularly, it pertains to plastics which have been rendered electrically conductive by treatment with certain trialkylphosphine oxides.

It is a known technique to reduce the build-up of troublesome electrostatic charges on plastic articles such as films, sheets, fibers and the like by increasing their electrical conductivity. In general, two approaches have been followed. The most common of these consists in treating the plastic with hygroscopic compounds, referred to in the art as antistats, which absorb atmospheric moisture to form on the plastic surface a layer of water, thereby providing a conductive path over which the static charges can flow to the ground or be dissipated to the atmosphere. Most effective in this regard are ionic antistats which not only absorb water but supply it with ions for increased conductivity. The principal categories of antistats which function by water absorption include quaternary ammonium salts, amine derivatives, hydrophilic phosphate esters, derivatives of polyhydric alcohols, for example, sorbitol and glycerine, and polyglycol esters of fatty acids.

The antistats aforesaid can be applied directly to the plastic article using such familiar coating procedures as dipping or spraying. For greater permanence, however, the antistats are incorporated in the body of the plastic. Such internal antistats function by a process of slow and continuous migration to the surface of the plastic to establish thereon, a self-replenishing moisture absorbing layer.

Polymers and plastic products can also be made conductive through the addition of electrically conductive fillers, for example, metal powders, flakes or fibers. Carbon is another common conductive filler and is available as specially prepared powders and graphitic fibers. Laminates of thin metal foils are also employed.

Neither of the above-outlined techniques for reducing static charges on plastics is satisfactory. In the case of the antistat compounds, the conductive water layer cannot be maintained at low humidities. Conductive fillers are objectionable in that sufficient quantities are needed in order to provide conductive paths by actual impingement. At these loading levels (theoretically 25 volume percent), physical properties, for example, ductility, flexibility and toughness are severely compromised. The thin metal foils are fragile and delicate; conductive paths are subject to mechanical disruption. Moreover, the use of metal foils and conductive fillers results in a system that is opaque, thereby limiting and curtailing its application.

A class of antistats that does not depend on absorbed surface moisture to provide conductivity in polymer systems are the trialkylphosphine oxides disclosed in U.S. Pat. No. 3,709,852 to Gordon et al. The patent states that a "special advantage of these phosphine oxides is that—in contradistinction to most other known antistatic agents—they are not liquid or as soft as wax, but that they can be easily comminuted to give a voluminous powder"; column 3, lines 9–14. Another advantage of these phosphine oxides is their low toxicity, exhibiting LD=50 values in rats of 1 to 10 grams per kilograms of body weight.

The phosphine oxides of the Gordon et al patent are structurally characterized by the presence of three alkyls attached to the phosphorus atom, two of said alkyls having 1 to 3 carbon atoms while the third alkyl can vary from 3 to 24 carbon atoms. In all of the examples, the phosphine oxides are dimethyl higher alkyl phosphine oxides; these also exhibit the lowest toxicity, the LD=50 being 10 grams per kilogram of body weight for tetradecyl dimethyl phosphine oxide.

Tertiary phosphine oxides have also been used to prevent fogging of photographic silver halide emulsions by static charges that build up from handling of the light sensitive materials, for example, winding of film on reels and camera spools or other frictional movement. Effectiveness of the antistats is difficult to assess since they are rated by photographic test procedures for measuring fog; see U.S. Pat. No. 3,582,340 to Kuwabara et al.

It has now been discovered that, contrary to the teachings of the prior art, liquid trialkylphosphine oxides exhibit greater antistatic behavior by several orders of magnitude than their solid counterparts. This unexpected development came about from applying the concept that electrical conductivity of phosphine oxides involves orientation of the molecules in an electric field thereby providing paths of alternating semipolar bonded atoms of P and O; that such orientation does not occur or is greatly suppressed in crystalline phosphine oxides; that such orientation is favored in noncrystalline trialkylphosphine oxides. Although a complete mechanism whereby phosphine oxides conduct electricity is not established, freedom to orient in the electric field and to become positioned for association seems to be the principal requirement.

Trialkylphosphine oxides, as a class, are low-melting, highly crystalline solids. To obtain liquid products, individual members are blended to provide mixtures which through mutual melting point depression remain in the liquid state. However, it is desirable to prepare even more complex mixtures for added protection against crystallization. It has been found that this can be effected by reacting phosphine simultaneously with different olefins followed by oxidation of the reaction product as illustrated in the following scheme:

$$3\ RCH{=}CH_2 + PH_3 \longrightarrow (RCH_2CH_2)_3\,P \xrightarrow[H_2O_2]{[O]} (RCH_2CH_2)_3\,P{=}O$$

wherein R is alkyl of 1 to 16 carbon atoms in an olefinic mixture. When two or more olefins are so-employed, a statistical distribution of phosphine oxides is realized, thereby providing a sufficient number of components to depress the melting point well below room temperature.

Under room temperature conditions, the herein mixed trialkylphosphine oxides vary in consistency from thin, oily liquids to glass-like solids which are believed to be in the nature of supercooled liquids. As understood herein, both of these are included within the term "liquid" trialkylphosphine oxides. The added complexity of forming these mixtures during their preparation helps assure they will remain liquid or at least glassy.

Exemplary polymers which can be rendered electrically conductive by treatment with the herein liquid trialkylphosphine oxides are of the thermoplastic type such as polyethylene, polypropylene, polybutene, polypentene, polyhexene and other poly α-olefins and copolymers of ethylene with α-olefins; polyamides, polystyrene, polymeric esters, for example, polymethacrylates and the like. The antistatic plastic compositions of the invention may contain other adjuncts familiar in the art of plastic formulation such as stabilizers, lubricants, nucleating agents, plasticizers, fillers, pigments and other processing components.

The novel electrically conducting polymers of the invention afford excellent protection against static electrically to meet a variety of situations and conditions. These include accumulation of dust and dirt from electrostatic attraction; unpleasant shocks to personnel and handling problems such as can occur during windup of highly charged film or when static material has a tendency to stick to metal parts. Perhaps nowhere is the problem of static electricity more acute than in the electronics industry where increased microminiaturization of components makes them extremely vulnerable to damage from even relatively low voltage discharges, as low as 100 to 200 volts, for example. It is estimated that the electronics industry sustained at least 500 million dollars of damage in 1981 from ruined equipment due to static electricity. Since the antistatic plastic composition herein can be formulated to give conductivities as low as $10^8$ ohms.cm, they are particularly useful in protecting delicate microcircuitry against damage from low voltage which requires greater conductivity for its removal.

In addition to their antistatic properties, the mixed liquid trialkylphosphine oxides of the invention possess other useful and valuable characteristics. For instance, liquid decyl hexyl octylphosphine oxide, a representative member of the series obtained by reacting molar proportions of 1-hexene, 1-octene and 1-decene with phosphine followed by oxidation of the reaction mixture, is capable of plasticizing nylon. This is indeed surprising in view of nylon's inertness and incompatibility with the normally used plasticizers. Even more surprising, however, are the properties of nylon plasticized with the herein liquid trialkylphosphine oxides. Particularly noteworthy in this regard is the unusually high luster of fibers spun from these novel plasticized nylon compositions. Dyed fabrics manufactured from such transparent fibers should, therefore, exhibit much greater color brightness compared with conventional nylon textiles. Another surprising and further unexpected property of the herein plasticized nylon is that during cold drawing, the resulting fibers become increasingly more extendable without any apparent loss of tensile strength. Normally, incorporation of a plasticizer in a polymer causes a decrease—not an increase in physical strength.

Plastic films containing the liquid trialkylphosphine oxides of the invention are rendered more transparent. For example, polyethylene film, which tends to be milky or hazy, was obtained in highly clarified form. Similar results were realized with nylon film.

It is believed that the presence of the herein mixed liquid trialkylphosphine oxides in the plastic promotes alignment of the polymer chains thereby increasing the crystallinity of oriented plastic materials. This could account for their enhanced clarity and fiber strength. However, it is to be understood that the foregoing is offered by way of an explanation and is not to be taken as limiting the invention.

The quantity of liquid trialkylphosphine oxide incorporated in the polymer is not especially critical although it will be appreciated that excessively large amounts above that needed to achieve the desired antistatic effect or other properties should be avoided. In general, the limiting quantity will be that below which blooming of the additive occurs on the surface of the plastic substrate. When used as an antistatic agent, the amount required is inversely proportional to the voltage to be discharged, that is, low voltages require larger additions than high voltages. Normally, the plastic compositions of the invention will contain from about 0.1% to about 20% of the phosphine oxide based on the weight of the polymer. Dissipation of low voltages generally requires high percentages, approaching 20%. To realize fiber lustrousness, on the other hand, or film clarity, relatively minute amounts will suffice, on the order of 0.1%.

Minimum quantities of phosphine oxide required will depend not only on the level of static dissipation desired but the polymer system to be treated. Included in the latter should be the effects of all other components. Polyethylene, which in commercial materials normally contains minimum or no interfering additions, can be rendered highly capable of electrostatic discharge with about 1.0 parts phosphine oxide per hundred of resin. In contrast polypropylene, which must be modified with an antioxidant stabilizer, normally requires higher levels to achieve the same performance. The reasons for this are not entirely understood but it is believed that most phenolic type antioxidants interact by hydrogen-bonding with the phosphine oxide, reducing its capability to associate in a conducting mode.

The upper limit of effectiveness is determined principally by the extent to which the phosphine oxide is compatible with the polymers. Rate of static discharge increases with increasing concentrations of additive until the level is reached at which surface "blooming" occurs. Higher levels then show no further increases.

That the discharge mechanism is volume related rather than limited to surface effects, is illustrated by using polypropylene which is highly compatible with the phosphine oxides. Here both sheet resistance and volume resistivity as well as the desired static dissipation time continue to decrease as the amount of phosphine oxide increases. This is in contrast with the commercial surface action electrostatic treatments where sheet resistance and static discharge time may decrease with increases in the amount of additive but the volume resistance is unaffected.

Further evidence that the phosphine oxides exert their influence in the interior of the polymer is found in the changes which occur in physical properties and appearance. When polyethylene film is produced, distension during blowing approximately doubles when the phosphine oxide is present, indicating an increase in melt fluidity. Furthermore, the film acquires an enhanced transparency and sparkle. In the case of nylon crystallinity, as determined by microcolorimetry, it is reduced by one-fourth to one-half in molded specimens. The extensibility of nylon fibers is approximately doubled at no sacrifice in tensile strength while luster is greatly increased, giving the appearance of natural silk.

Reference is made to the following examples and procedures.

EXAMPLE 1

Mixed Decyl Hexyl Octyl Phosphine Oxide

Forty-eight hundred and fifty grams of 1-hexene (57.6 moles), 6,460 grams of 1-octene (57.6 moles) and 8,070 grams of 1-decene (57.6 moles) were introduced into a 10 gallon 316 stainless steel pressure autoclave. Nineteen hundred grams of phosphine ($PH_3$) (55.9 moles) were next charged in. The reactor was then heated to 110° C. and a mixture of 70 grams of azobisisobutyronitrile (AIBN) in 2,110 grams of toluene was then metered into the reactor over a period of 3½ hours using a pressure pump. The reactor pressure at the start of the AIBN addition was 240 psig. There was sufficient exotherm to maintain the reaction temperature without additional heat during the first half of the AIBN addition. Heat was required during the second half. The vessel pressure fell from 240 psig to 30 psig at the end of the AIBN addition. Following the AIBN addition, the 110° C. temperature was held for 3 hours and then the reaction was cooled. There was recovered 23,420 grams of material from the reactor.

The crude product was then vacuum stripped to remove excess olefins and toluene (4,917 grams). The analysis of the overhead material showed 12.4% hexene, 15.2% octene, 17.8% decene and 43.7% toluene. The residue weighed 18,615 grams.

The residue product was then oxidized with 5,287 grams of 30% $H_2O_2$ (54.5 moles). The oxidized product was then stripped of water under vacuum to yield 19,089 grams of phosphine oxide product. The material was a yellow oil in appearance.

The following analysis was obtained by gas chromatography.

| Phosphine Oxide | |
|---|---|
| HHH | 2.85% |
| HHO | 9.12% |
| HOO and HHD | 19.38% |
| HOD and OOO | 24.32% |
| HDD and OOD | 22.36% |
| ODD | 11.81% |
| DDD | 4.0% |

H = Hexyl, O = Octyl, D = Decyl attached to phosphorus in

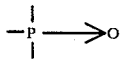

EXAMPLE 2

Polyethylene Film Containing Liquid Mixed Hexyl Octyl Decylphosphine Oxide

Polyethylene (Petrothene 145A, sold by the U.S.I. Company) pellets were mixed with hexyl, octyl, decylphosphine oxide (HODPO-111) from Example 1 at 1.5 parts per hundred of resin (phr) and converted into blown film on a Haake extruder. The equipment was started with unmodified polyethylene and without adjusting conditions was fed a mix of polymer and phosphine oxide. As soon as the modified polyethylene emerged, the bubble nearly doubled in size and the film transparency improved markedly. The resulting film was easily heat sealed and showed excellent antistatic performance including conductivity across the seam.

General Compounding Procedure for Preparing Polymer Plaques for Antistat Testing The phosphine oxide antistatic agents of the invention were mixed with the plastic or polymer by melt blending in a Brabender Plastograph which is sold by C. W. Brabender Instruments, Inc., 50 East Wesley Street, South Hackensack, N.J. A No. 6 roller head was used. After preheating the head to the appropriate temperature, about 190° C. for polyethylene and styrene, 200° C. for polypropylene and 280° C. for nylon, a charge of 35 to 40 grams of polymer pellets is added and mixed until torque leveled off. The phosphine oxide was then introduced. Some error may occur during transfer, but should always be in the same direction, that is, slightly lower concentration than noted. With polyethylene specimens, losses are further minimized by weighing into a polyethylene film blister which is blended in toto with the mix. Greater losses tend to occur with the more volatile additives, although this effect is offset to some extent owing to the depression in vapor pressure of the phosphine oxides by the polymer. After mixing was complete, 60 mil test plaques or thin (<10 mil) films were obtained by compression molding.

Resistivity Measurement

Resistivity of films and plaques can be determined by measurements in an apparatus described in ASTM Method D257-78, Appendix X3. However, difficulties were found in establishing a good contact between the flat polymer surface and electrodes. It was found that more accurate and reproducible results are obtained by measurements made with equipment modified from ASTM Method D991-82, where the current is measured between two knife edge electrodes resting on a polymer sheet when a voltage is applied to the electrodes. The sheet resistance then is:

$$R = V/I \text{ (ohms)}$$

and the volume resistivity is:

$\rho = w \times d/1$ R (ohms-cm)

w = width of the sheet d = thickness of the sheet

1—distance between electrodes (all in cm.)

Static Dissipation Measurements

Static dissipation was determined in apparatus constructed along the guidelines of the Method 4046 of the Federal Test Method Standard No. 101C. Polymer sample sheets are charged to 5000 volts, the contact electrodes then are grounded and sample voltage is observed with an electrostatic field meter.

Data listed in Table I illustrate a number of effects of physical and chemical structure of phosphine oxides on conductivity and static charge dissipation. Loadings in polyethylene for these samples were all impractically high resulting in definite blooming of excess additive to the surface. However, the data show that none of the crystallizable phosphine oxides (TPPO, TOPO, THPO and TBPO) were good performers even under these favorable circumstances although all caused some increase in conductivity versus the control and there was invariably at least a modest acceleration of charge bleed-off. The TPPO and TOPO samples showed definite crystallization, evident to the naked eye, although visible crystal formation required a day or so in the case of the latter sample. The THPO and TBPO samples did not grow crystals but their formation was suspected from the slow loss of electrical performance with aging. On the other hand, samples containing HOPO and BHOPO, neither of which is crystallizable because of the multiplicity of components did not show significant change in electrical properties on aging for several months or on exposure to relative humidities varying from >80% to <25%. In contrast, resistivity ($\rho$) for the control polyethylene remained immeasurably high for all conditions and static charges, once applied to the surface, often could still be measured after standing overnight.

Behavior of the two remaining samples, BHPPO and HHPPO, illustrates the relatively poor performance of phosphine oxides containing polar groupings in the alkyl substituents. Although both are inherently complex liquids (note each contains a crystallizable fraction of tris(hydroxypropyl)phosphine oxide), they proved to be inferior electrically. This is attributed to inter- and intra-hydrogen bonding to nucleophilic phosphoryl oxygen. It is believed that this interferes with the requisite phosphoryl dipole associations. The degree of activity shown is perhaps attributable largely to the trialkyl fraction in the complex mixtures which exists at a much higher concentration in HHPPO than in BHPPO.

Table II illustrates several problems encountered in employing TBPO in combination with TOPO as the antistatic additives. TBPO is the highest phosphorus content phosphine oxide readily available commercially and was, therefore, evaluated extensively for blending. Although blends of the two appear to be noncrystallizing liquids over a range of compositions, this liquidity does not seem to persist when compounded into polyethylene, especially when added at concentrations exceeding the limits of compatibility in the resin, or about 2 to 3 parts per hundred. Losses of TBPO (b.p. <150° C.) occurring during compounding and possibly during molding discussed elsewhere probably continue, although slowly, on simple storage of specimens. Gradual deterioration of electrical performance has been observed in some cases. All of the data in Table II were obtained on samples aged at least a month. Reductions in conductivity and antistatic behavior are also attributable to crystallization. Presumably, however, this in turn results from volatilization of TBPO leaving the TOPO free to crystallize. This complexity of TOPO concentration probably explains the apparent contradiction of electrical performance improving with reduced levels of additives with the best having only modest contents of phosphine oxides.

A mixed phosphine oxide (HOPO) prepared from equimolar quantities of hexene and octene is inherently noncrystallizable by virtue of its complex nature. It is a highly effective antistatic agent in polyethylene at a concentration of about two parts per hundred (Table III). Blends with TBPO also perform well. A very thin film (0.5 mil) prepared from a blend of 2 phr HOPO and 0.5 phr TBPO showed excellent antistatic performance when fresh but gradually lost effectiveness over a period of months presumably because of volatility of the TBPO portion. A blend with TOPO did not crystallize.

A complex mixed phosphine oxide prepared from phosphine and equimolar quantities of butene, hexene and octene (BHOPO) has proved especially effective for low density polyethylene processing, see Table IV.

Data in Table V indicate that polypropylene is more difficultly rendered conductive and antistatic than is polyethylene even at relatively high levels of conventional phosphine oxides. The mixed phosphine oxide (BHOPO) shows relatively good performance even though the processing temperatures 190° C.–200° C. may result in some volatization of the lower alkyl fractions.

In Table VI is summarized the results of testing the electrical properties of polypropylene compositions prepared by compounding polypropylene (Hercules Profax 6523) with hexyl, octyl decylphosphine oxide (HODPO-111) and compression molding into 1/16"×6"×6" plaques. Some discoloration occurred which was attributed to interaction of the phosphine oxide with antioxidant in the resin. Referring to the data in the table, it will be noted that the volume conductance of the polypropylene increases rapidly with increasing amounts of the HODPO-111 additive. In fact, at 15 parts per hundred of resin, the plaque had become so conductive that heating occurred at 400 volts and the applied EMF was hence reduced accordingly. That the conductivity is an internal effect is readily apparent from the much higher rate of increase in volume conductivity with increasing addition concentration compared with that of the surface conductivity. These tests demonstrate quite clearly that the antistatic properties of the liquid trialkylphosphine oxides of the invention are not due to formation of a conductive surface by reaction with moisture as is the case with presently used commercial antistats.

Table VII shows the electrostatic discharge (ESD) times for a series of nylon films containing various concentrations of liquid mixed hexyl octyl decylphosphine oxide (HODPO-111). The films were prepared by mixing at 280° C. NYPEL-114, a 6,6 nylon available from Nypel, Inc., West Conshohocken, Pa., in a Brabender Plastograph which is sold by C. W. Brabender Instruments, Inc., 50 East Wesley Street, South Hackensack, N.J., with the indicated quantity of HODPO-111. Thin films (about 10 mils) were made by pressing the plastic composition between Teflon® sheets at 280° C. and 1000 psi. A similar series of films were prepared except trioctylphosphine oxide, a solid phosphine oxide, was used. These films were much inferior in conductivity to those containing the aforesaid liquid phosphine oxide (HODPO-111) as evidenced by the fact they did not charge to the full 5 KV in the ESD test and required 240 seconds to allow the measured charge to drop from 3.7 KV to 1.2 KV. As the data in Table VII show, the discharge times for the compositions of the invention varied from about three to less than one second.

Table VIII lists the electrostatic discharge (ESD) times in seconds of polyethylene plaques containing a mixed liquid hexyl octyl decylphosphine oxide antistat of the invention for various mole ratios of hexyl, octyl and decyl content. The compounds were prepared by reacting phosphine with the indicated molar ratio mixture of hexene-1, octene-1 and decene-1 under free radical conditions. As the data in Table VIII show, ESD times of 1 to 2 seconds were exhibited, indicating excellent antistatic properties for all of the test plaques at the various molar ratios of hexyl, octyl and decyl moieties.

In Table IX are listed the electrostatic data obtained on a series of 60 mil plaques produced by compounding methyl methacrylate polymer with hexyl octyl decylphosphine oxide. The methyl methacrylate used in making the plaques was polymer beads which had been dried at 80° C. for about one hour.

Table X shows the static dissipation time (sometimes abbreviated ESD for electrostatic discharge time) for cast polymethacrylate and polystyrene films. The polymethacrylate film was prepared by dissolving 100 parts of polymethacrylate resin (Rohm and Haas Plexiglas® V-062) and 10 parts of hexyl, octyl, decylphosphine oxide in a 1:1:1 mole ratio (HODPO-111) from Example 1 in a solvent containing 900 parts of methylene chloride and 156 parts of methyl chloroform. The solvent was evaporated and the static dissipation time of 90% ($t_{90\%}$) was determined. Similarly, the polystyrene film was cast from a solution of 100 parts polystyrene resin (Dow Corp. Styron® 666U), 10 parts HODPO-111, 900 parts methylene chloride, 156 parts methyl chloroform and 136 parts toluene. The static dissipation time of the film was determined after evaporation of the solvent.

TABLE I

Effect of Crystallization on Antistatic Behavior of Phosphine Oxides in Polyethylene

| | Additive | phr[1] | M.P. | Vol. Resty. (ohm · cm) | Static Dissipation Time (sec.)[2] $t_{50\%}$ | $t_{90\%}$ |
|---|---|---|---|---|---|---|
| 0 | none | 0.0 | — | $>10^{14}$ | >>400 | — |
| 1 | TPPO | 5.0 | 154 | $>6.5 \times 10^{13}$ | >120 | —[4] |
| 2 | TOPO | 5.0 | 52 | $3.3 \times 10^{13}$ | 100 | >120 |
| 3 | THPO | 5.0 | 38 | $1.2 \times 10^{13}$ | 10 | 40[3] |
| 4 | TBPO | 5.0 | 69 | $3.7 \times 10^{13}$ | 60 | >120 |
| 5 | HOPO | 5.0 | <25 | $3.7 \times 10^{11}$ | 4 | 11[4] |
| 6 | BHOPO | 5.0 | <25 | $4.3 \times 10^{11}$ | — | <2 |
| 7 | BHPPO | 5.0 | <25 | $6.5 \times 10^{13}$ | 10 | 54 |
| 8 | HHPPO | 5.0 | <25 | $6.8 \times 10^{12}$ | 10 | 110[3] |

TPPO = triphenyl phosphine oxide
TOPO = trioctyl phosphine oxide
THPO = trihexyl phosphine oxide
TBPO = tributyl phosphine oxide
HOPO = phosphine oxide prepared from 1:1 blend of hexene and octene with phosphine
BHOPO = phosphine oxide prepared from 1:1:1 blend of butene, hexene and octene with phosphine
BHPPO = phosphine oxide prepared from 2:1 allyl alcohol and 2-butene with phosphine
HHPPO = phosphine oxide prepared from 2:1 allyl alcohol and 1-hexene with phosphine
[1]phr = parts per hundred parts of resin, at low concentrations approximate (%)
[2]Dissipation time in seconds of 50% and 90% of static charge respectively
[3]Surface blooming
[4]Crystallization

TABLE II

Mixtures of Tributyl and Trioctyl Phosphine Oxides in Polyethylene (Tenite 1830A)

| phr TBPO | phr TOPO | Vol. Resty. (ohm · cm) | Static Dissipation Time (Sec.) $t_{50\%}$ | $t_{90\%}$ |
|---|---|---|---|---|
| 3.9 | 7.9 | $3.3 \times 10^{13}$ | 33 | 65[1] |
| 2.6 | 5.3 | $2.2 \times 10^{13}$ | 31 | 39[1] |
| 1.7 | 3.3 | $3.3 \times 10^{13}$ | 20 | 70[1] |
| 1.2 | 2.5 | $2.2 \times 10^{13}$ | 2.0 | 5.4[1] |
| 1.0 | 1.9 | $2.0 \times 10^{10}$ | 1.6 | 2.0 |
| 0.6 | 1.3 | $6.3 \times 10^{13}$ | 3.7 | 11[1] |
| 1.25 | 1.25 | $3.0 \times 10^{10}$ | 0.15 | 0.5[1] |
| 0.9 | 0.9 | $>6.5 \times 10^{13}$ | 5.3 | 15 |
| 0.6 | 0.6 | $1.5 \times 10^{11}$ | 1.9 | 3.6 |
| 0.3 | 0.3 | $2.2 \times 10^{13}$ | 1.8 | 3.2 |

[1]Crystallization

TABLE III

Mixed Phosphine Oxide Prepared From 1:1 Blend of Hexene and Octene and Blends With Trialkylphosphine Oxides In Polyethylene (Tenite 1830A)

| HOPO (phr) | Second Phosphine Oxide (phr) | Vol. Resty. (ohm · cm) | Static Dissipation Time (Sec.) $t_{50\%}$ | $t_{90\%}$ |
|---|---|---|---|---|
| 5.0 | — | $1.8 \times 10^{9}$ | 0.01 | 0.04[1] |

TABLE III-continued

Mixed Phosphine Oxide Prepared From 1:1 Blend of Hexene and Octene and Blends With Trialkylphosphine Oxides In Polyethylene (Tenite 1830A)

| HOPO (phr) | Second Phosphine Oxide (phr) | Vol. Resty. (ohm · cm) | Static Dissipation Time (Sec.) $t_{50\%}$ | $t_{90\%}$ |
|---|---|---|---|---|
| 2.5 | — | $2.6 \times 10^{9}$ | 0.008 | 0.02[1] |
| 1.5 | — | $1.5 \times 10^{10}$ | 0.05 | 0.15[1] |
| 1.2 | — | $3.7 \times 10^{9}$ | 0.02 | 0.08[1] |
| 1.0 | — | $5.2 \times 10^{9}$ | 0.04 | 0.01[1] |
| 3.7 | TBPO 1.0 | $1.1 \times 10^{10}$ | 0.1 | 0.15[1] |
| 1.0 | TBPO 1.0 | $1.2 \times 10^{9}$ | 0.015 | 0.05 |
| 0.87 | TBPO 0.87 | $3.8 \times 10^{9}$ | 0.08 | 0.25 |
| 0.75 | TBPO 0.75 | $1.1 \times 10^{10}$ | 0.008 | 0.02 |
| 0.6 | TBPO 0.75 | $1.4 \times 10^{11}$ | >120 | |
| 0.5 | TBPO 1.0 | $6.0 \times 10^{9}$ | .05 | 0.25 |
| 2.5 | TOPO 2.5 | $7.5 \times 10^{9}$ | .015 | 0.1 |

[1]Surface blooming

TABLE IV

Mixed Phosphine Oxide Prepared From 1:1:1 Blend of Butene, Hexene, and Octene (BHOPO) in Polyethylene[1]

| BHOPO (phr) | Vol. Resty. (ohm · cm) | Static Dissipation Time (Sec.) $t_{50\%}$ | $t_{100\%}$ |
|---|---|---|---|
| 5.2 | $4.3 \times 10^{11}$ | — | <2[2] |
| 3.3 | $1.9 \times 10^{9}$ | 0.01 | 0.02[2] |
| 2.6 | $1.7 \times 10^{9}$ | 1.2 | 2.6[2] |
| 2.4 | $1.3 \times 10^{9}$ | 0.01 | 0.02[2] |
| 2.1 | $6.8 \times 10^{8}$ | 0.01 | 0.02[2] |
| 1.9 | $2.6 \times 10^{9}$ | 0.02 | 0.05[2] |
| 1.3 | $6 \times 10^{9}$ | 0.05 | 0.1 |

[1]Tenite 1830A
[2]Surface blooming

TABLE V

Phosphine Oxides in Polypropylene[1]

| Phosphine Oxide | phr | Vol. Resty. (ohm · cm) | Static Dissipation Time (Sec.) $t_{50\%}$ | $t_{90\%}$ |
|---|---|---|---|---|
| None | — | $>10^{14}$ | 300 | |
| BHPPO | 2 | $6.5 \times 10^{13}$ | 120 | |
| BHPPO | 4 | $6.5 \times 10^{13}$ | 120 | |
| BHPPO | 6 | $6.5 \times 10^{13}$ | 120 | |
| BHPPO | 8 | $6.5 \times 10^{13}$ | 120 | |
| TBPO | 6 | $1.1 \times 10^{13}$ | 7.6 | 21 |
| TOPO | 6 | $2.5 \times 10^{12}$ | 0.9 | 1.3[2] |
| TOPO | 4 | $8.1 \times 10^{12}$ | 50 | 120[2] |
| HHPPO | 6 | $6.5 \times 10^{13}$ | 120[2] | |
| TOPO | 5.3 | $6.2 \times 10^{9}$ | .05 | 0.25[2] |
| TOPO | 7.9 | $5.4 \times 10^{9}$ | .015 | .05[3] |
| BHOPO | 10 | $4.3 \times 10^{10}$ | 0.1 | 0.3 |
| BHOPO | 7.5 | $1.1 \times 10^{10}$ | 0.08 | 0.12 |
| BHOPO | 5.0 | | 0.45 | 1.5 |
| BHOPO | 2.5 | | 9.0 | 25 |

[1]Profax 6523
[2]Surface blooming
[3]Crystallization

TABLE VI

Conductivity of Polypropylene[1] [2] Containing Mixed Liquid Hexyl Octyl Decylphosphine Oxide

| HODPO-111 (phr) | Static Dissipation Time (Sec.) $t_{90\%}$ | Sheet Conductance Current (nA) at 1000 V | Volume Conductance Current (nA) at 400 V |
|---|---|---|---|
| 0 | >>120 | <<1 | <<1 |
| 5 | 17 | <1 | 1 |
| 7.5 | 4.7 | 1 | 8 |
| 10 | 0.2 | 13 | 143 |
| 12.5 | 0.1 | 28 | 1303 |
| 15 | 0.04 | 70 | 7620 (300 V) |

TABLE VI-continued

Conductivity of Polypropylene[1] [2] Containing Mixed Liquid Hexyl Octyl Decylphosphine Oxide

| HODPO-111 (phr) | Static Dissipation Time (Sec.) $t_{90\%}$ | Sheet Conductance Current (nA) at 1000 V | Volume Conductance Current (nA) at 400 V |
|---|---|---|---|
| 17.5 | 0.02 | 164 | 13,380 (300 V) |
| 20 | 0.015 | 209 | 15,720 (200 V) |

[1]Profax 6523
[2]Compression molded 6" × 6" × 1/16" plaques

TABLE VII

Conductivity of Nylon 6/6 Containing Liquid Mixed Hexyl, Octyl, Decylphosphine Oxide

| Concentration (phr) | Static Dissipation Time (Sec.) $t_{90\%}$ |
|---|---|
| 2.0 | 3.1; 3.3 |
| 2.5 | 1.5; 1.9 |
| 3.0 | 1.0; 1.4 |
| 5.0 | <1.0; <1.0 |
| 8.0 | <1.0; <1.0 (blooming) |
| 0.0 | 349; 326 |

TABLE VIII

ESD Times of Polyethylene Containing Hexyl, Octyl, Decyl Mixed Phosphine Oxides

| Mole Ratio 4:0:0 | Static Dissipation Time (Sec.) $t_{90\%}$ |
|---|---|
| 1:1:1 | 1.4 |
| 1:1:4 | 2.0 |
| 1:4:4 | 1.6 |
| 4:1:4 | 1.0 |
| 1:2:4 | 1.4 |
| 2:1:2 | 1.0 |

Polyethylene test plaques (6" × 6" × 1/16" prepared from 38 grams USI Petrothene 145A and 0.55 grams phosphine oxide (1.45 phr)

TABLE IX

Hexyl Octyl Decyl Phosphine Oxide in Poly (Methyl Methacrylate)[1] [2] [3]

| HODPO-111 (phr) | Static Dissipation Time (sec.) $t_{90\%}$ | Sheet Conductance Current (nA) at 1000 V | Volume Conductance Current (nA) at 1000 V |
|---|---|---|---|
| 0 | >>120 | | |
| 2.5 | Will not charge | <1 | <1 |
| 5.0 | 19.5 | <1 | 1 |
| 7.5 | 2.6 | 1 | 4 |
| 10.0 | 1.4 | 3 | 5 |
| 12.5 | 0.7 | 10 | 11 |

TABLE IX-continued

Hexyl Octyl Decyl Phosphine Oxide in Poly (Methyl Methacrylate)[1] [2] [3]

| HODPO-111 (phr) | Static Dissipation Time (sec.) $t_{90\%}$ | Sheet Conductance Current (nA) at 1000 V | Volume Conductance Current (nA) at 1000 V |
|---|---|---|---|
| 15.0 | 0.5 | 11 | 9 |
| 17.5 | 0.4 | 8 | 16 |
| 20.0 | 0.7 | 5 | 18 |

[1]Rohm and Haas Co., Plexiglas V-062
[2]Compression molded 6" × 6" × 1/16" plaques
[3]Hexyl Octyl Decyl Phosphine Oxide in 1,1,1 molar ratio

TABLE X

Static Dissipation of Cast Films of Hexyl Octyl Decly Phosphine Oxide[1] in Polystyrene[2] and Methyl Methacrylate[3]

| Resin | HODPO-111[1] phr | Static Dissipation Time (sec.) ($t_{90\%}$) |
|---|---|---|
| Methyl-methacrylate[2] | 10 | 0.14 |
| Polystyrene[3] | 10 | 0.14 |

[1]Hexyl Octyl Decyl Phosphine Oxide in a 1:1:1 Mole Ratio
[2]Methyl Methacrylate Film Plexiglas V-062
[3]Polystyrene Film Styron 666 U

What is claimed is:

1. A polymer composition having antistatic properties comprising a thermoplastic polymer having incorporated therein an effective amount of a liquid mixture of trialkylphosphine oxides wherein each of the alkyls contain from 4 to 18 carbon atoms.

2. The composition of claim 1 wherein the amount of phosphine oxides ranges from about 0.1% to about 10.0% by weight of the composition.

3. The composition of claim 1 wherein the alkyls are decyl, hexyl and octyl radicals.

4. The composition of claim 1 wherein the liquid phosphine oxides are obtained by reaction of phosphine with a mixture of $C_4$ to $C_{18}$ olefins followed by oxidation.

5. The composition of claim 4 wherein the olefins are a mixture of decene-1, hexene-1 and octene-1.

6. The composition of claim 1 wherein the polymer is selected from the group consisting of polyethylene, polypropylene, polystyrene, polyamide and polymeric esters.

7. The composition of claim 1 wherein the thermoplastic polymer is a film.

8. The composition of claim 1 wherein the thermoplastic polymer is a fiber.

9. A polymer composition having antistatic properties comprising a thermoplastic polymer selected from the group consisting of polyethylene, polypropylene and polystyrene, said polymer having incorporated therein an effective amount of a liquid mixture of trialkylphosphine oxides wherein each of the alkyls contain from 4 to 18 carbon atoms.

* * * * *

UNITED STATES PATENT AND TRADEMARK OFFICE

CERTIFICATE OF CORRECTION

PATENT NO. : 4,552,687

DATED : November 12, 1985

INVENTOR(S) : Harry H. Beacham and Paul R. Mucenieks

It is certified that error appears in the above-identified patent and that said Letters Patent is hereby corrected as shown below:

Column 10, line 16, under "Second Phosphine Oxide (phr)", "TBPO 0.75" should read --TBPO 0.6--.

Signed and Sealed this

*Fourth* Day of *March 1986*

[SEAL]

*Attest:*

DONALD J. QUIGG

*Attesting Officer*

*Commissioner of Patents and Trademarks*